US009797399B2

(12) United States Patent
Kitazawa

(10) Patent No.: US 9,797,399 B2
(45) Date of Patent: Oct. 24, 2017

(54) VACUUM PUMP WITH LIGHTER CAP

(71) Applicant: TAIHO KOGYO CO., LTD., Toyota-shi, Aichi (JP)

(72) Inventor: Naoki Kitazawa, Toyota (JP)

(73) Assignee: TAIHO KOGYO CO., LTD., Toyota-shi (JP)

( * ) Notice: Subject to any disclaimer, the term of this patent is extended or adjusted under 35 U.S.C. 154(b) by 12 days.

(21) Appl. No.: 14/873,741

(22) Filed: Oct. 2, 2015

(65) Prior Publication Data

US 2016/0097391 A1 Apr. 7, 2016

(30) Foreign Application Priority Data

Oct. 3, 2014 (JP) ..... 2014-205282

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 18/344*** | (2006.01) |
| ***F01C 21/08*** | (2006.01) |
| ***F04C 25/02*** | (2006.01) |

(52) U.S. Cl.

CPC ..... *F04C 18/3441* (2013.01); *F01C 21/0809* (2013.01); *F01C 21/0881* (2013.01); *F04C 18/344* (2013.01); *F04C 25/02* (2013.01)

(58) Field of Classification Search

CPC .... F01C 21/0809; F01C 21/0881; F01C 1/44; F01C 1/3446; F04C 18/344; F04C 18/3441; F04C 25/02; F04C 29/02

USPC ..... 418/254–256, 145–146

See application file for complete search history.

(56) References Cited

U.S. PATENT DOCUMENTS

| | | | | |
|---|---|---|---|---|
| 2,373,656 | A * | 4/1945 | Brull | F04C 2/344 418/147 |
| 5,421,706 | A * | 6/1995 | Martin, Sr. | F04C 2/3441 418/255 |
| 8,267,678 | B2 | 9/2012 | Ohtahara et al. | |
| 2010/0000207 | A1* | 1/2010 | Heaps | F04C 2/3441 418/255 |
| 2010/0092323 | A1 | 4/2010 | Ohtahara et al. | |
| 2012/0076682 | A1* | 3/2012 | Sakakibara | F04C 2/3441 418/255 |

FOREIGN PATENT DOCUMENTS

| | | | |
|---|---|---|---|
| JP | 2004-263690 | A | 9/2004 |
| JP | 4165608 | B1 | 10/2008 |

* cited by examiner

*Primary Examiner* — Theresa Trieu
(74) *Attorney, Agent, or Firm* — Andrews Kurth Kenyon LLP

(57) ABSTRACT

In the vane pump comprising the housing, the vane, and the cap, the sliding surface of the cap is configured as arc shape in the view from the rotational axis direction and the width toward the sliding direction of the cap is configured to be smaller than the width at the sliding angle field which is virtual area for contacting the inner surface of the pump room among the circumference including the arc shape of the sliding surface of the cap and to be bigger than the width at the high loading area where the load added to the sliding surface which is bigger than the predetermined value among the sliding angle field.

2 Claims, 4 Drawing Sheets

VACUUM PUMP WITH LIGHTER CAP

CROSS-REFERENCE TO RELATED APPLICATION

The present application claims priority to Japanese Patent Application No. 2014-205282 filed on Oct. 3, 2014, which is incorporated herein by reference in its entirety.

TECHNICAL FIELD

The present invention relates to a vacuum pump attached to an engine body.

BACKGROUND ART

Conventionally, a vane type vacuum pump which is used as a vacuum pump for a car is known (Patent Literature 1). The conventional vacuum pump is configured to provide lubrication oil to a sliding part of a rotor which rotates in pump room of the housing and the lubrication oil after lubrication at the sliding member is discharged with gas through discharge passage to outer part of the pump room with rotation of the rotor.

In this vane of the vacuum pump, a cap sliding on the inner surface at the rotation is attached. The cap is pressed to the housing at the rotation of the vane and constructed to seal between the surface of the housing and the vane (for example, it is described in the Patent Literature 1 and in the Patent Literature 2.).

PRIOR ART REFERENCE

Patent Literature

Patent Literature 1: the Japanese Granted Patent Publication No. 4165608

Patent Literature 2: the Japanese Unexamined Patent Publication No. 2004-263690

DISCLOSURE OF INVENTION

Problems to Be Solved by the Invention

In the vane and the cap of the vacuum pump described in the above prior art, it is necessary that the weight saving of the vacuum pump is attained and the product cost is restrained by keeping the strength of the vane and the cap and attaining the weight saving.

In consideration of the above problems, the present invention provides the vacuum pump which attains the weight saving and the restraint of the product cost by the weight saving of the vane and the cap with keeping the strength of the vane and the cap.

Means for Solving the Problems

Problems to be solved by the invention are described as above and the means for solving the problems is explained.

A vacuum pump including a housing which has a pump room inward, a vane which is disposed in the pump room and rotated by a rotor and divides the pump room to workspaces, and a cap in which a sliding surface slid on inner surface of the pump room is configured and which is attached at the tip of the vane. The sliding surface of the cap is configured as an arc shape in the view from the rotational axis direction, and the width toward the sliding direction of the cap is configured to be smaller than the width at the sliding angle field which is virtual area for contacting the inner surface of the pump room among the circumference including the arc shape of the sliding surface. Also, the sliding surface of the cap is configured to be bigger than the width at the high loading area where the load added to the sliding surface which is bigger than the static value among the sliding angle field.

The width of the vane is configured to be equal to the width toward the sliding direction of the cap.

Effect of the Invention

As effects of the invention, the effects shown as below are caused.

Namely, by the vacuum pump according to this invention, the weight saving and the restraint of the product cost are attained by the weight saving of the vane and the cap with keeping the strength of the vane and the cap.

DETAILED DESCRIPTION OF THE INVENTION

Figure 1:
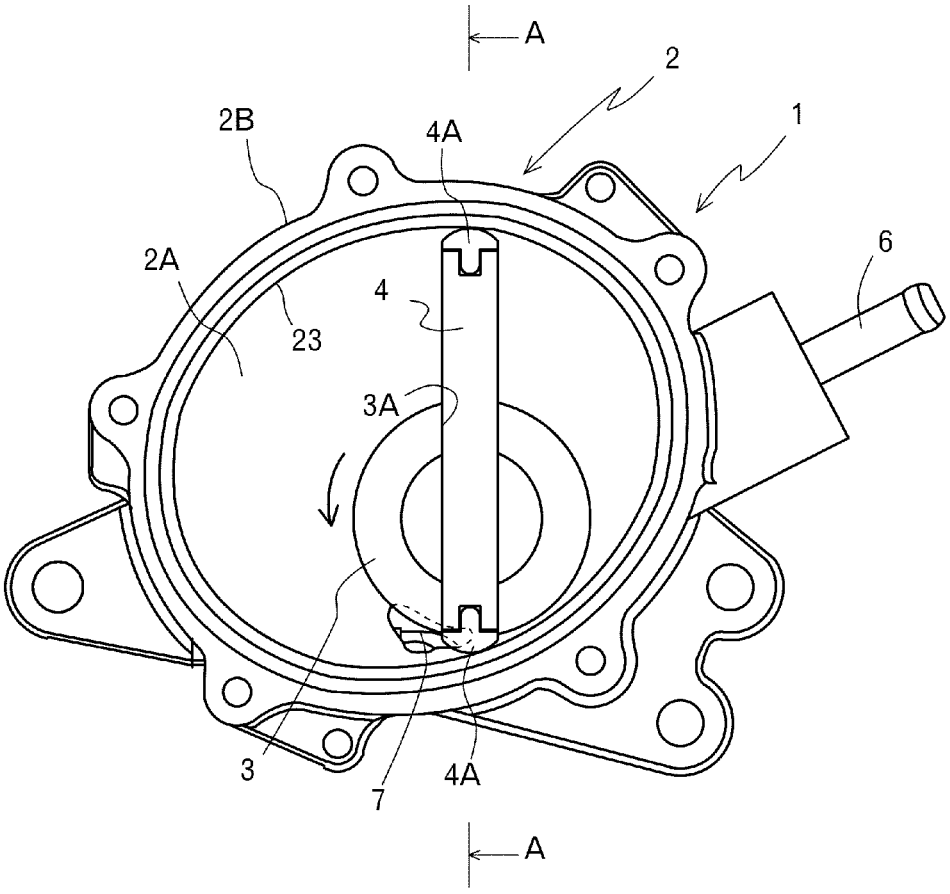
FIG. 1 is a sectional view of a vacuum pump according to this embodiment.

A vane pump 1 according to an embodiment of the vacuum pump of this invention is explained with FIG. 1 to FIG. 4.

The vane pump 1 is fixed at the side of the engine room which is not shown and for example the vane pump 1 is acted as a negative pressure source of a power brake which is not shown.

The vane pump 1 provides a housing 2 shaped as stepped cylinder which has a pump room 2A shaped as substantially circle, a rotor 3 which is disposed in the pump room 2A and disposed as the center of axis is eccentric from the center of the pump room 2A, vane 4 which is disposed in the pump room 2A and rotated with the rotor 3 to the direction of the arrow and always divides the pump room 2A to workspaces, and the cover 5 which shut an opening of a large-diameter portion 2B of the housing 2, namely an opening of one edge of the pump room 2A.

The housing 2 provides the large-diameter portion 2B in which the pump room 2A is configured, a small-diameter portion 2C which is configured adjacent to the edge surface of the large-diameter portion 2B, and a cap portion 2D which shut an opening part of the small-diameter portion 2C and holds the rotor 3 rotatably by the inner surface of the small-diameter portion 2C. In the large-diameter portion 2B of the housing 2, a suction passage 6 to suck gas (air) from the power brakes to the pump room 2A is provided and in the suction passage 6 a clack valve which is not shown is provided to keep the negative pressure of the power brake.

Figure 2:
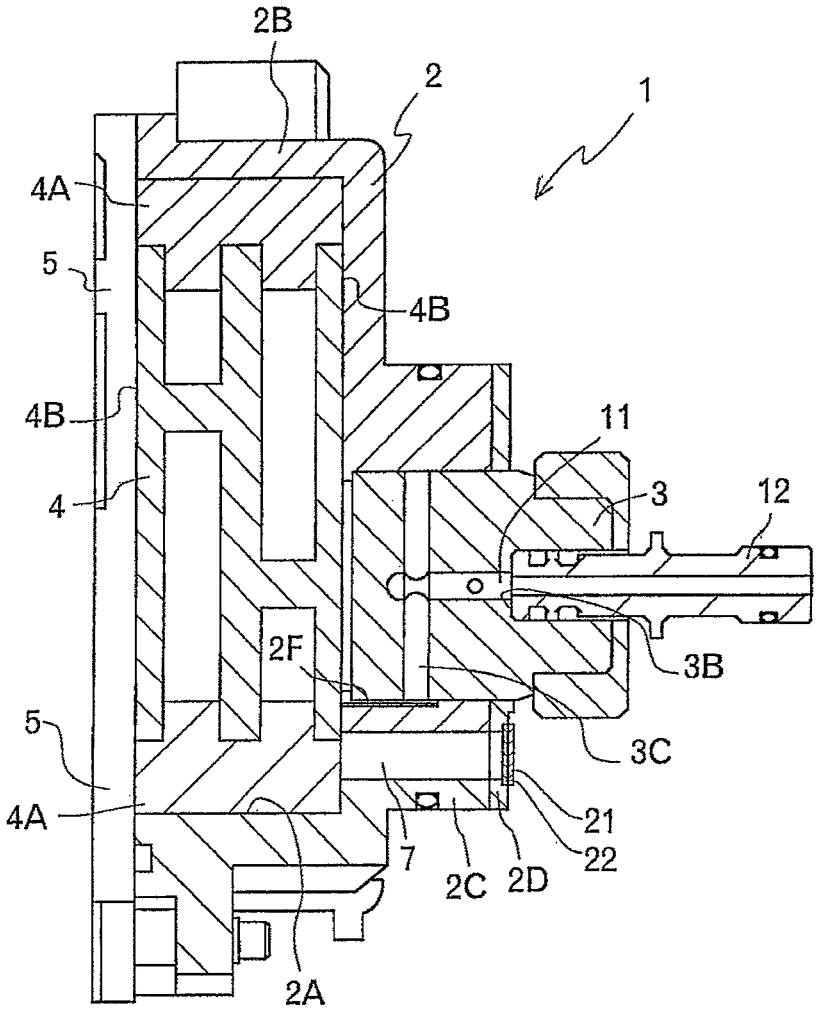
FIG. 2 is a sectional view at A-A line in the FIG. 1.
Figure 3:
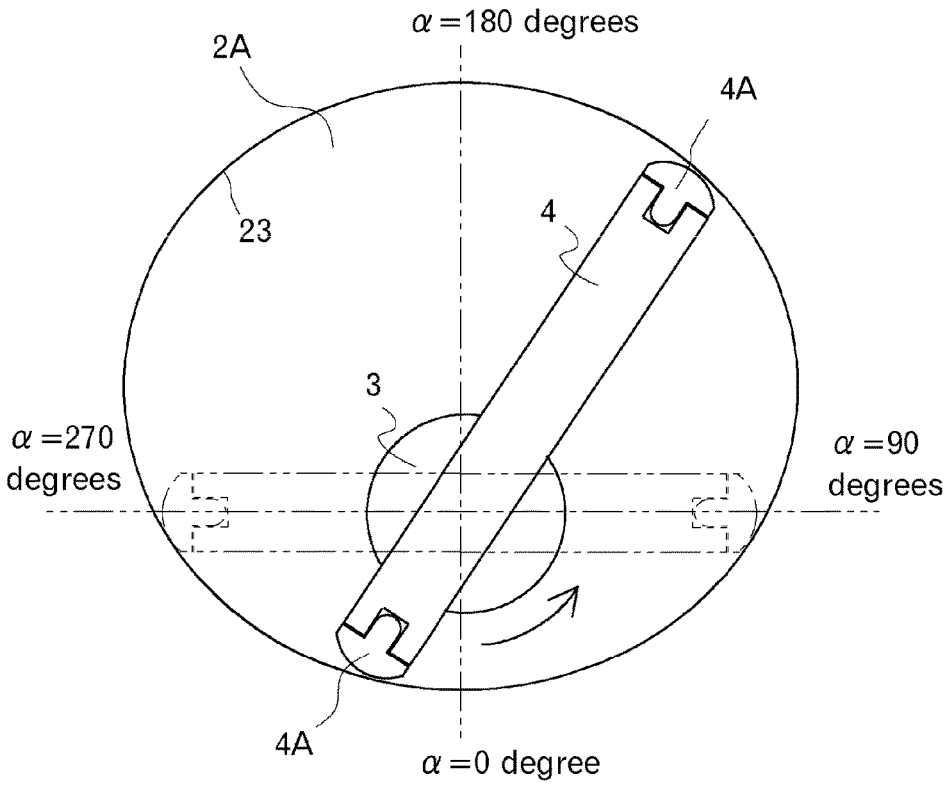
FIG. 3 is a view in which the rotation angle of the vane is shown.

In the small-diameter portion 2C and the lower part of the cap portion 2D according to the FIG. 1 and the FIG. 2, the through hole is provided in the axial direction to pierce from the pump room 2A to the small-diameter portion 2C and the outside of the cap portion 2D. This through hole is configured as a discharge passage 7 to discharge the gas from the pump room 2A to the outside of the housing 2. Thus, the edge of the through hole at the cap portion 2D is configured as the discharge-side outlet of the discharge passage 7.

As shown in the FIG. 2, the discharge-side outlet of the discharge passage 7 is openably covered by a thin platy reed valve 22 which has elasticity. In detail, a platy stopper 21 which has high hardness is disposed to overlap the reed valve 22 and the reed valve 22 and stopper 21 is fixed on the cap portion 2D and the small-diameter portion 2C (described as the small-diameter portion 2C in the following) by the bolt which is fastener and so on. The reed valve 22 and stopper 21 is configured as arc shaped along the outer surface of the small-diameter portion 2C.

At the edge in the axial direction of the rotor 3 in the pump room 2A, a guide groove 3A in the diameter direction is configured and a platy vane 4 is attached with the guide groove 3A slidably in the diameter direction. Each cap 4A, 4A which is slid on the inner surface 23 of the pump room 2A is attached with the one of both edges of the vane 4. As shown in the FIG. 1 and the FIG. 3, when the rotor 3 and the vane 4 are rotated toward arrow direction, both caps 4A, 4A are slid on the inner surface 23 of the pump room 2A to keep the airtight and both end faces 4B, 4B in the axial direction of the vane 4 are slid on the inner wall of a cover 5 and inner wall of the pump room 2A and the part of the outer surface of the rotor 3 is kept to contact the inner surface 23 of the pump room 2A. Therefore, the inner space of the pump room 2A is divided as the expandable workspace. As shown in the FIG. 3, the position in which the cap 4A is closest to the inner surface 23 of the pump room 2A is defined as the rotation angle $\alpha=0$ degree and the rotation angle $\alpha$ is increased as the counter clockwise direction in the view from the rotation axle direction of the rotor (the orthogonally cross direction to the paper in the FIG. 1, FIG. 3, and FIG. 4). According to this embodiment, the sliding direction of the cap 4A is defined as the orthogonally cross direction to the diameter direction of the rotor 3 (As shown in the FIG. 4).

From the axis part at other edge side of the rotor 3 to the inner surface of the housing 2, the oil supplying passage 11 to supply the lubrication oil to the inner part of the pump room 2A is configured. The oil supplying passage 11 is consisted of a hole in the axis direction 3B which is provided at the axis part of the rotor 3 and connected to the oil supplying pipe 12, a hole in the diameter direction 3C which is continued from the other edge of the hole in the axis direction 3B, and further the groove in the axial direction 2F of the housing 2 which is connected to the hole in the diameter direction 3C intermittently when the rotor 3 is rotated to the arrow direction.

When the engine is driven, the rotor 3 and the vane 4 are rotated to the arrow direction in FIG. 1 with the drive of the engine and the volume of each workspace is extended or reduced. Following this, the gas (air) in the power brake is sucked through a suction passage 6 into each workspace and the gas in each workspace is discharged into the engine room which is the outside of the pump room 2A through the discharge passage 7. When the rotor 3 and the vane 4 are rotated, the lubrication oil is supplied into the pump room 2A and to the sliding part of the vane 4 through the oil supplying passage 11. After the lubrication oil which flowed into the pump room 2A is primary-stored in the lower part of the pump room 2A, the lubrication oil is moved by the vane 4 and the cap 4A which are rotated and flowed through the discharge passage 7. The lubrication oil is discharged from the discharge-side outlet into the engine room which is the outside of the housing 2 at the time of opening the reed valve.

As described above, because the vane is attached slidably with the guide groove 3A of the rotor 3, when the rotor 3 and the vane 4 are rotated, the load of the vane 4 is greatly added to the cap 4A which is disposed at the side of the center of gravity (the center part in the longitudinal direction) to the center of the rotor 3. Thus, the rotation angle $\alpha$ becomes more than 90 degrees and less than 270 degrees in the FIG. 3, the greater load than the predetermined value is added as the load added to the sliding surface 41*f*, the cap 4A which is disposed at the side in which the most part of the vane 4 is extended from the rotor 3.

Figure 4:
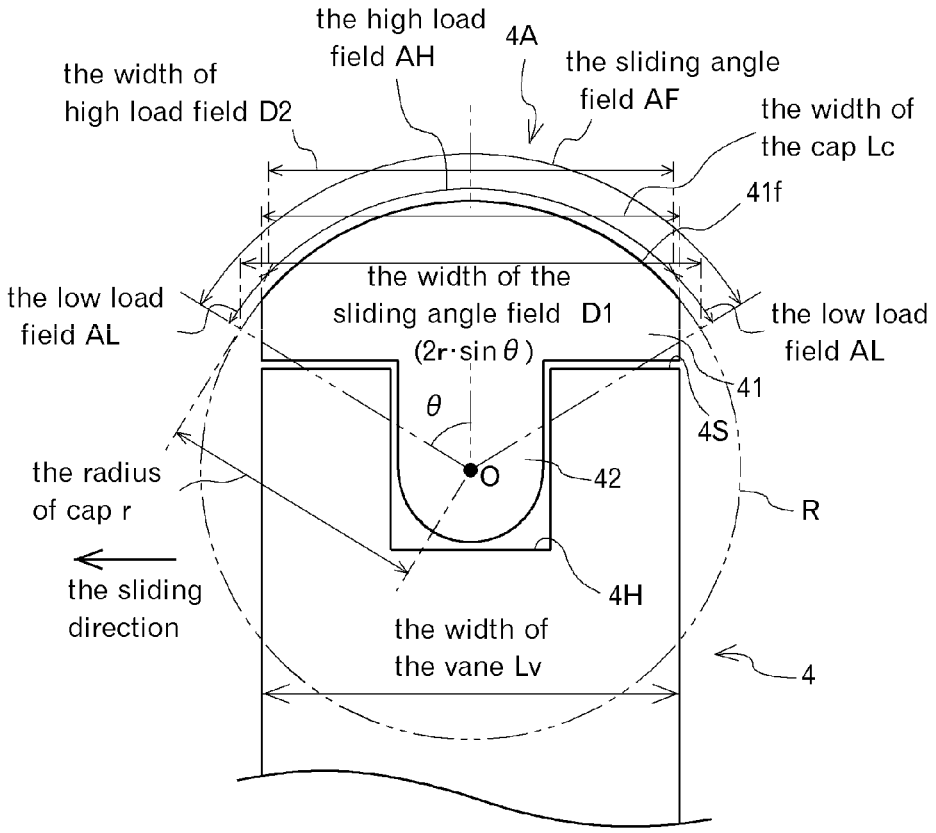
FIG. 4 is an enlarged view in which the relation between the vane and the cap.

Next, the relation between the vane 4 and cap 4A is described with the FIG. 4. As shown in the FIG. 4, the hollow 4H and the bearing surface 4S are configured at both edges in the longitudinal direction. The hollow 4H is the schematic square shaped hollow which is extended along the longitudinal direction of the vane 4. The bearing surface 4S is configured at both side surfaces in the longitudinal direction of the vane 4.

As shown in the FIG. 1 and the FIG. 4, the cap 4A is attached with the both edges in the longitudinal direction of the vane 4. The body part 41 and the leg part 42 are configured at the cap 4A. The sliding surface 41*f* which is configured as arc-shaped in the rotation axis direction of the rotor 3 is configured at the side of the housing 2 of the body part 41. As shown in the FIG. 4, the distance between the center O of the circumference R which includes the sliding surface 41*f* of the cap 4A and the sliding surface 41*f* is the radius of the cap r.

The leg part 42 is the part which is extended to the side of the vane 4 from the center of the right and left direction at the side of the vane 4 of the body part 41. The leg part 42 is configured to be smaller than hollow 4H of the vane 4. In the leg part 42, the length of the vane along the longitudinal direction is configured to be shorter than the depth of the hollow 4H. The cap 4A is attached with the both edges in the longitudinal direction of the vane 4 by fitting the leg part 42 to the hollow 4H of the vane 4. Thus, the body part 41 of the cap 4A is disposed at the outside in the longitudinal direction of the vane 4.

As shown in the FIG. 4, there is the sliding angle field AF which is virtual field contacted with the inner surface 23 of the pump room 2A on the circumference R which includes the sliding surface 41*f* of the cap 4A. The sliding angle field AF is defined as the field contacted with the inner surface 23 of the pump room 2A in case that it is presumed that the circumference surface with the circumference R exists while the rotation angle $\alpha$ of the cap 4A increases from 0 degree to 360 degrees (until the vane 4 is rotated once). Thus, the sliding angle field AF is the field in which the circumference surface with the circumference R is contacted with the inner surface 23 while the cap 4 is rotated once along the inner surface 23 of the pump room 2A. In other words, while the cap 4 is rotated once along the inner surface 23 of the pump room 2A, the part except for the sliding angle field AF in the circumference surface with the circumference R is not contacted to the inner surface 23. As shown in the FIG. 4, the half of the angle which is configured between the two lines from the both edges of the sliding angle field AF to the center O of the circumference R is defined as the sliding angle $\theta$. Thus, the width D1 of the sliding angle field AF is $2r\cdot\sin\theta$. The point in which the outermost part of the sliding angle field AF is contacted with the inner surface 23 is an adjacent the point in which the rotation angle α of the vane is 60 degrees (300 degrees).

As shown in the FIG. 4, there is the high load field AH in which the load added to the sliding surface 41*f* is bigger than the predetermined value in the sliding angle field AF. The high load field AH is the field of the sliding angle field AF in which the circumference surface with the circumference R is contacted with the inner surface 23 while the load of the vane 4 is greatly added to the cap 4A at the side of the center of gravity vane 4 against the center of the rotor 3, and thus the vane 4 is disposed as the rotation angle α is the range of 90 degrees to 270 degrees. Thus the width of the high load field AH is width D2. The field except for the high load field AH in the sliding angle field AF is defined as the low load field AL. Thus, the circumference surface with the circumference R is contacted with the inner surface 23 of the pump room 2A at the low load field AL of the sliding surface 41*f* while the rotation angle α of the vane 4 is less than 90 degrees and more than 270 degrees.

As shown in the FIG. 4 according to this embodiment, the width of cap Lc which is the width in the sliding direction of the cap is configured as to be shorter than the width D1 of the sliding angle field AF and to be longer than the width D2 of the high load field AH. Thus, the sliding surface 41*f* is contacted with the inner surface 23 at the high load field AH and the strength of the cap 4A is able to be kept. As the sliding surface 41*f* is smaller than the sliding angle field AF, the cap 4A is able to be downsized. In the low load field AL the sliding surface is not existed and the corner of the cap 4A (the both edges of the sliding surface 41*f*) is contacted with the inner surface 23. The load added to the cap 4A in the low load field AL is small and the problem to concentrate the stress at the inside the cap 4A for the overload and so on is not occurred.

According to this embodiment, width of vane Lv which is the width in the sliding direction of the vane is configured to be equal to the width of cap Lc. Therefore, the force added to the cap 4A from the vane 4 is transmitted by the whole bearing surface 4S and the strength of the vane 4 is able to be kept. The width of vane Lv is smaller than the width D1 of the sliding angle field AF and the cap 4A is able to be downsized. Therefore, the downsizing of the vane pump 1 is attained and the product cost is restrained.

INDUSTRIAL APPLICABILITY

The present invention is acceptable to the skill of the vacuum pump and acceptable to the vacuum pump attached to the engine body.

DESCRIPTION OF NOTATIONS

1 vane pump (vacuum pump)
2 housing
2A pump room
4 vane
4A cap
23 inner surface
41*f* sliding surface
AF sliding angle field
AH high load field

The invention claimed is:

1. A vacuum pump comprising:
a housing, which has a pump room inward,
a vane, which is disposed in the pump room and rotated by a rotor, and which divides the pump room into workspaces, and
a cap, which has a sliding surface that slides on an inner surface of the pump room and which is attached at a tip of the vane, wherein
the sliding surface of the cap has an arc shape in a rotational axis direction, and
in a sliding direction, a width of the cap is configured to be smaller than a width of a sliding angle field and bigger than a width of a high load field, wherein
the sliding angle field represents an arc segment of a virtual circular circumference including the sliding surface of the cap, and includes all points on the virtual circular circumference in contact with the inner surface of the pump room while a rotation angle of the cap increases from 0 degree to 360 degrees in a counterclockwise direction, and
the high load field is a portion of the sliding angle field where a load applied to the sliding surface is greater than a predetermined load value in the sliding angle field.

2. The vacuum pump according to claim 1, wherein a width of the vane is configured to be equal to the width of the cap in the sliding direction.

* * * * *